US007185579B2

(12) United States Patent
Allart et al.

(10) Patent No.: US 7,185,579 B2
(45) Date of Patent: Mar. 6, 2007

(54) HYDRAULIC RADIAL PISTON MOTOR

(75) Inventors: Bernard Allart, Crepy-en-Valois (FR); Louis Bigo, Compiegne (FR)

(73) Assignee: Poclain Hydraulics Industrie, Verberie (FR)

( * ) Notice: Subject to any disclaimer, the term of this patent is extended or adjusted under 35 U.S.C. 154(b) by 451 days.

(21) Appl. No.: 10/499,947

(22) PCT Filed: Dec. 20, 2002

(86) PCT No.: PCT/FR02/04491

§ 371 (c)(1),
(2), (4) Date: Jun. 23, 2004

(87) PCT Pub. No.: WO03/056171

PCT Pub. Date: Jul. 10, 2003

(65) Prior Publication Data

US 2005/0120874 A1 Jun. 9, 2005

(30) Foreign Application Priority Data

Dec. 24, 2001 (FR) ..... 01 16817

(51) Int. Cl.
*F03C 1/04* (2006.01)

(52) U.S. Cl. ..... 92/72; 91/492; 91/491; 91/498

(58) Field of Classification Search ..... 91/491, 91/492; 92/72
See application file for complete search history.

(56) References Cited

U.S. PATENT DOCUMENTS 4,522,110 A 6/1985 Samuelsson
4,898,076 A * 2/1990 Bigo et al. ..... 91/491
4,953,524 A * 9/1990 Wusthof et al. ..... 91/491
5,081,906 A * 1/1992 Lemaire et al. ..... 91/491
5,090,295 A * 2/1992 Cunningham et al. ..... 91/491
6,978,713 B2 * 12/2005 Allart et al. ..... 92/72

FOREIGN PATENT DOCUMENTS

| | | |
|---|---|---|
| DE | 829553 | 1/1952 |
| DE | 2634065 | 2/1978 |
| DE | 10033264 | 10/2001 |
| EP | 0935069 | 8/1999 |
| FR | 2587761 | 3/1987 |

* cited by examiner

*Primary Examiner*—Ehud Gartenberg
*Assistant Examiner*—Vikansha Dwivedi
(74) *Attorney, Agent, or Firm*—Ladas & Parry LLP

(57) ABSTRACT

A hydraulic motor having radial pistons, and comprising a cam, a cylinder block and a distributor. The cylinders of the cylinder block are connected to communication orifices (32A) situated in a communication face of the cylinder block, while the distributor has a distribution face in which distribution orifices (21A, 23A) are provided that are suitable for communicating with the communication orifices for rotating the motor. The cam is provided with a plurality of lobes (50, 50'), each of which has two ramps (51, 52), each ramp corresponding to a distribution orifice (21A, 23A). The edge of each of at least certain communication orifices (32A) has at least one notch (54A, 54B) suitable for establishing a small section of communication with a distribution orifice. The invention applies in particular to hydraulic motors having radial pistons for which the ratio between the number of cylinders and the number of cam lobes is in the vicinity of 1.

10 Claims, 3 Drawing Sheets

HYDRAULIC RADIAL PISTON MOTOR

The present invention relates to a hydraulic motor having radial pistons, and comprising a cam and a cylinder block that are suitable for turning relative to each other about an axis of rotation, the cylinder block having radial cylinders connected via cylinder ducts to communication orifices situated in a communication face of the cylinder block that is perpendicular to the axis of rotation, pistons mounted to slide in the cylinders being suitable for co-operating with the cam, which cam is provided with a plurality of lobes, each of which has two ramps, the motor further comprising a fluid distributor having a distribution face that is perpendicular to the axis of rotation and that is suitable for being in abutment against the communication face of the cylinder block, said distribution face being provided with distribution orifices comprising orifices suitable for being connected to a fluid feed and orifices suitable for being connected to a fluid discharge, the fluid distributor being constrained to rotate with the cam, so that there is one ramp of the cam that corresponds to each distribution orifice, said distribution orifices being suitable for communicating one after another with the communication orifices while the cylinder block and the distributor are turning relative to each other.

For a motor of this type, operating at full cubic capacity, each communication orifice comes successively to face a distribution orifice connected to the fluid feed and comes to face a distribution orifice connected to the fluid discharge. The communication orifice in question being coupled to the distribution orifice that is connected to the feed causes the piston contained in the cylinder connected to said communication orifice to be pushed radially outwards, while the same communication orifice being coupled to a distribution orifice that is connected to the fluid discharge makes it possible to cause said piston to return into its cylinder, towards the axis of the motor. Thus, each piston co-operates successively with the various portions of the lobes of the cam so as to enable the cylinder block and the cam to rotate relative to each other.

The spacing between the distribution orifices and the spacing being the communication orifices are such that a communication orifice is not simultaneously connected to two distribution orifices respectively connected to the fluid feed and to the fluid discharge.

While the cylinder block and the distributor are rotating relative to each other, the working chambers of the cylinders, i.e. the portions of said cylinders that are defined under the pistons, are placed alternately at high pressure and at low pressure. Therefore in said working chambers, changes in pressure generally take place at a very fast rate. Such changes in pressure subject the pistons to proportional forces, and said forces are transmitted by the pistons to the cam.

As a result, the components of the motor, in particular its casing, are subjected to the variation in load, which causes noise-generating vibration, the intensity of the noise generated depending mainly on the speed of the increases and decreases in pressure in the working chambers.

In order for the motor to operate correctly, the difference in pressure between the fluid feed and the fluid discharge is large. When a piston contributing to the drive torque reaches the end of its stroke towards its position that is furthest from the axis of the motor (top dead center), due to the communication orifice of its cylinder being connected to a distribution orifice connected to the fluid feed, the same communication orifice is isolated from said distribution orifice, and is then connected to another distribution orifice which is connected to the fluid discharge. This results in a phenomenon of pressure reduction in the cylinder of the piston in question, the fluid present at a high pressure in the cylinder being suddenly put into communication with a significantly lower pressure, which is the pressure of the fluid discharge. Conversely, when the piston reaches the bottom dead center of its stroke (its position that is closest to the axis of the motor), its cylinder is isolated from the fluid discharge, and is then connected to the fluid feed so as to enable the piston to travel over a centripetal stroke again. At this instant, the fluid contained in the cylinder goes from a low pressure to a pressure that is much higher, which is the pressure of the fluid feed. A phenomenon of pressure reduction also generally takes place, from the fluid feed, towards the cylinder. In the preceding case, the pressure reduction takes place from the cylinder towards the fluid discharge.

In both cases, the pressure reductions that take place generate jolting or juddering sensations, and noises such as knocking.

The more the quality of such motors is improved, and the greater the extent to which leaks are reduced in such motors, the more perceptible such phenomena become. In old motors, the leaks prevailing in them made it possible to avoid variations in pressure that were too sudden between the various enclosures.

In order to avoid, or at least to limit the jolting phenomena due, in particular, to the fluid contained in the working chambers of the cylinders expanding too quickly when the communication ducts are put into communication, via the distribution orifices, with the fluid feed, it is possible to equip the edge of each of the distribution orifices with at least one notch suitable for acting, while the cylinder block and the distributor are rotating relative to each other, to establish a small section of communication between the working chambers of the cylinders and the distribution ducts. The small section of communication, which is open for a very short time, makes it possible to avoid pressure variations that are too sudden in the working chambers.

However, the applicant has observed that such a solution is not always easy to implement. In certain cases, it is not very easy and/or it is costly to form notches in the edges of the distribution orifices.

Therefore, an object of the invention is to propose another solution for avoiding or limiting the above-mentioned jolting phenomena.

This object is achieved by the fact that the edge of each of at least certain communication orifices is provided with at least one notch suitable for establishing a small section of communication with a distribution orifice.

The invention can be used particularly advantageously for motors in which the ratio of the number of cylinders to the number of cam lobes is in the vicinity of 1. A hydraulic motor having radial pistons has one distribution orifice for each of the ramps of its cam lobes, i.e. it has twice as many distribution orifices as it has cam lobes. Conversely, the motor has one communication orifice for each cylinder. Therefore, when the above-mentioned ratio is in the vicinity of 1, the motor has about twice as many distribution orifices as it has communication orifices. Forming notches in the edges of the communication orifices is thus considerably less costly than forming notches in the edges of the distribution orifices in the same type of motor.

As explained below, the invention covers the case when the edge of each communication orifice is provided with at least one notch, and also the case when only some of said orifices have their edges provided with notches, each of those orifices being provided with one or more notches.

Having said that, in either case, for the same technical effect and for a motor in which the ratio of the number of cylinders to the number of cam lobes is in the vicinity of 1, the number of communication orifices that need to be provided with notches is significantly smaller than the number of distribution orifices that need to be provided with notches.

The dimensions of the notches are chosen to allow a volume of fluid to pass gradually between the orifices at different pressures through said notches while the cylinder block and the fluid distributor are rotating relative to each other, which volume is referred to as a "pressure-compensating" volume, corresponding, for given operating rotation speeds and pressures, to decompression or pressure reduction of the maximum volume of the working chamber that is obtained at the top dead center of the piston on the cam. Passing a pressure-compensating volume of fluid through the constriction constituted by a notch, before fully-fledged communication is established between the communication orifice and a distribution orifice makes it possible to cause the pressure of the fluid at the communication orifice to vary gradually to bring it gradually to the pressure of the fluid at the distribution orifice. The lapse of time for which the notch makes it possible for fluid to pass between the communication orifice and the distribution orifice while the cylinder block and the distributor are rotating depends on the speed of rotation of the motor. That is why the operating pressures and the rotation speed are parameters to be taken into account in defining the notch.

The edge of each communication orifice has a leading portion via which communication between the communication orifice and the distribution orifices opens while the cylinder block and the distributor are turning relative to each other in a given direction of relative rotation, and a trailing portion via which communication between the communication orifice and the distribution orifices closes while the cylinder block and the distributor are turning relative to each other in the same direction of relative rotation.

In an advantageous variant, particularly suitable for motors having two operating directions, each leading portion and each trailing portion of the edges of at least certain communication orifices has a notch suitable for establishing a small section of communication with a distribution orifice.

The applicant has observed that the notches are particularly useful when the communication between the distribution orifices and the communication orifices is opening because, at that time, the pressure of the fluid contained in the working chambers and the pressure of the fluid contained in the distribution ducts (be it the feed pressure or the discharge pressure) are significantly different, and it is this pressure difference that, if the distribution orifices open too suddenly, generates jolts and noise. In other words, the presence of the notches is particularly desirable in the leading portions of the communication orifices. In certain uses, the motor always or nearly always turns in the same direction of rotation. This applies, for example, when the motor serves to drive grinding mills, conveyor belts or concrete mixers. In which case, it can suffice for only those portions of the edges of the communication orifices which, in this direction of rotation, form the leading portions of said edges, to carry notches.

In other uses, the motor is reversible, with two opposite directions of rotation. This applies, for example, when it serves to drive a turret of a mechanical digger. In which case, two opposite portions of the edges of each of the communication orifices can, depending on the direction of rotation of the motor, be a leading portion or a trailing portion. It is therefore desirable for each of the two portions to be provided with a notch.

In numerous uses, the motors are reversible and do not have a preferred direction of operation. For example, this applies when driving certain types of vehicles in translation, in particular tracked vehicles.

In which case, advantageously, the notches in the leading portion and in the trailing portion of the edge of each of said communication orifices are symmetrical.

Certain reversible motors do have a preferred operating direction. For example, motors for driving vehicles in translation can operate mainly at high speed in the forward direction while their speed is limited in the reverse direction. In which case, it is possible to provide large notches in those portions of the edges of the communication ducts which are leading portions in the preferred direction, and small notches can be provided on the portions opposite from said edges, which portions are the trailing portions in said preferred direction and the leading portions in the opposite, non-preferred direction.

The large notches make it possible to allow sections of communication with the distribution orifices that are larger than the sections of communication allowed by the small notches, e.g. in proportion to the ratio between the highest speeds of rotation of the motor permitted respectively in the preferred direction and in the non-preferred direction of said motor.

In an advantageous embodiment, in which each ramp of the cam has a convex portion and a concave portion, two adjacent ramps being connected together either via a cam crest zone extending between their respective convex regions, or via a cam trough zone extending between their respective concave regions, said cam crest zone and said cam trough zone are substantially circular arcs centered on the axis of rotation, so that when the pistons are co-operating with said zones, their radial strokes are substantially zero. The distribution orifices and the communication orifices thus advantageously have dimensions such that, while the cylinder block and the distributor are rotating relative to each other, each distribution orifice remains momentarily isolated from any communication orifice.

The cam crest and cam trough zones are substantially circular arcs centered on the axis of rotation, which means that the radii of curvature of said zones, as measured between their ends, are, for the cam crest zones, substantially equal to the minimum radial distance from the cam to the axis of rotation and, for the cam trough zones, substantially equal to the maximum radial distance from the cam to the axis of rotation. The radius of curvature of each of said zones can, however, be different respectively from the minimum radius and from the maximum radius of the cam but, substantially, their distances to the axis of the motor are respectively equal to said minimum and maximum radii. When a piston is co-operating with such zones, its radial stroke is substantially zero, which means that said stroke is zero or is at the most about 0.5% of the maximum amplitude of the stroke of the piston. Thus, the cam crest zones and the cam trough zones do not contribute to the drive torque. They cover small angular sectors, e.g. about 2° to 3°, and, while the cylinder block and the distributor are rotating relative to each other, they make it possible to offer dead center instants for each piston (top dead center for the cam trough zones and bottom dead center for the cam crest zones), during which the pressure in the working chamber of the cylinder in which the piston in question is moving can, by means of the compensation volume of fluid passing through a notch, equal or come close to the pressure of the distribution orifice.

It is particularly advantageous for the lapse of time for which a given communication orifice is in communication with a distribution orifice solely via the notch that is provided in the edge of said communication orifice to lie within the lapse of time for which the piston fed via said communication orifice co-operates either with a cam crest zone or with a cam trough zone. It is advantageous to use this time for which the piston does not develop any torque to cause the pressure in the working chamber to vary gradually by means of the notch in the edge of the communication orifice.

Advantageously, the angular sectors covered by a cam crest zone and by a cam trough zone are substantially equal to each other and lie substantially in the range 2° to 3°.

The invention will be well understood and its advantages will appear more clearly on reading the following detailed description of an embodiment shown by way of non-limiting example.

The description refers to the accompanying drawings, in which:

FIG. 1 shows a hydraulic motor comprising a fixed casing in three portions 2A, 2B, and 2C, assembled together by bolts 3.

Figure 1:
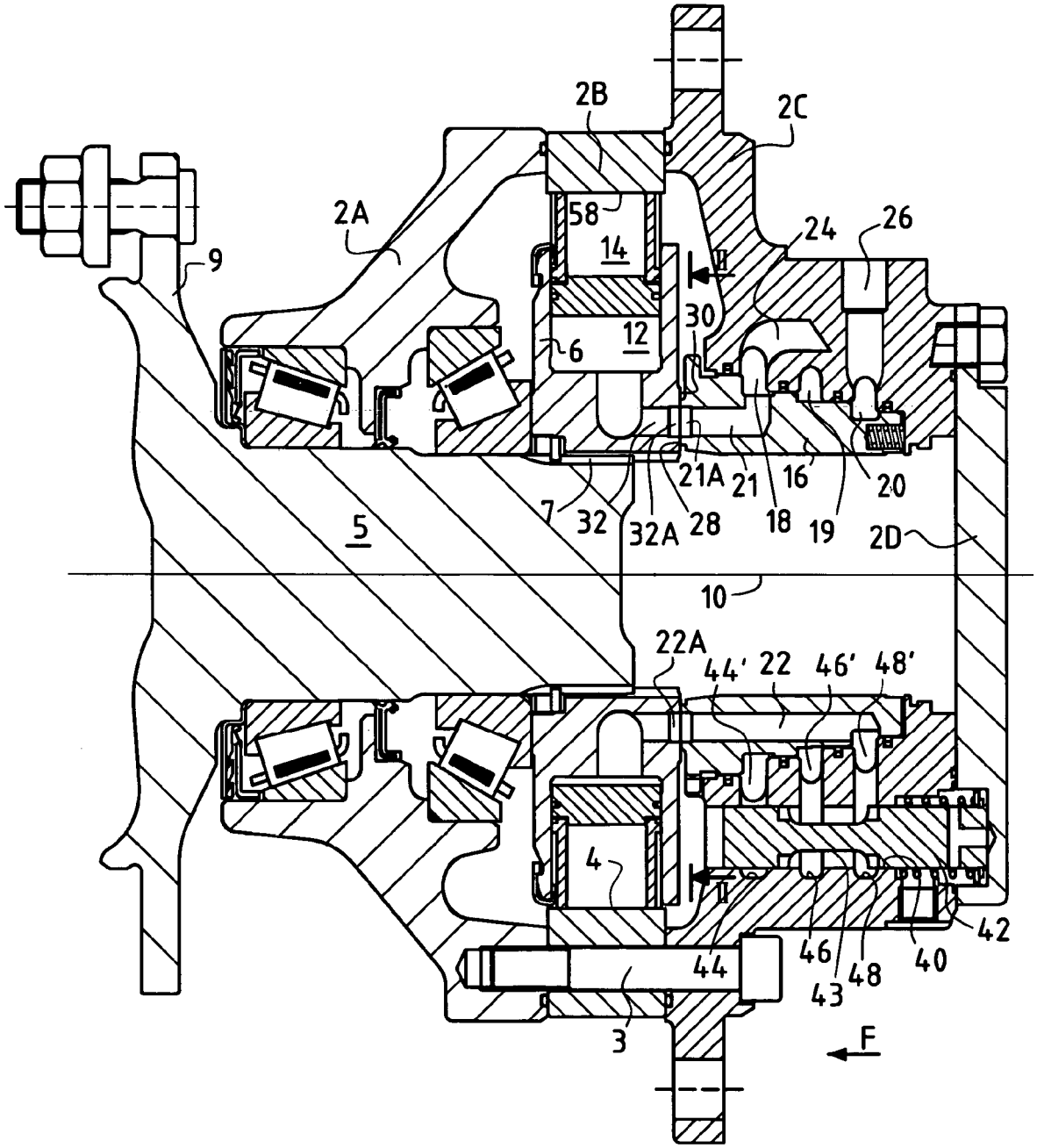
FIG. 1 is an axial section view of a hydraulic motor to which the invention can be applied.

Naturally, the invention is not limited to hydraulic motors having fixed casings, but rather it is also applicable to hydraulic motors having rotary casings and that are well known to the person skilled in the art.

The portion 2C of the casing is closed axially by a radial plate 2D that is also fixed by bolts. An undulating reaction cam 4 is formed on the portion 2B of the casing.

The motor includes a cylinder block 6 which is mounted to rotate about an axis of rotation 10 relative to the cam 4, and which comprises a plurality of radial cylinders which are suitable for being fed with fluid under pressure, and inside which the radial pistons 14 are slidably mounted.

The cylinder block 6 rotates a shaft 5 which co-operates with it via fluting 7. The shaft carries an outlet flange 9.

The motor also includes an internal fluid distributor 16 which is secured to the casing so that it is prevented from rotating relative thereto about the axis 10. Between the distributor 16 and the inside axial face of the portion 2C of the casing, distribution grooves are formed, namely a first groove 18, a second groove 19, and a third groove 20. The distribution ducts of the distributor 16 are organized in a first group of ducts which, like the duct 21, are all connected to the groove 18, a second group of ducts (not shown) which are connected to the groove 19, and a third group of ducts which, like the duct 22, are connected to the groove 20. The first groove 18 is connected to a first main duct 24 to which all of the distribution orifices of the distribution ducts of the first group, such as the orifice 21A, are connected. The third groove 20 is connected to a second main duct 26 to which all of the distribution orifices of the ducts of the third group, such as the orifice 22A of the duct 22, are connected.

Depending on the direction of rotation of the motor, the main ducts 24 and 26 are respectively a fluid exhaust duct and a fluid feed duct, or vice versa.

The distribution ducts open out in a distribution face 28 of the distributor 16, which face is in abutment against a communication face 30 of the cylinder block. Each cylinder 12 has a cylinder duct 32 that opens out in said communication face so that, while the cylinder block and the cam are rotating relative to each other, the cylinder ducts come into communication in alternation with the distribution ducts of the various groups.

The motor of FIG. 1 also includes a cubic capacity selector device which, in this example, comprises a bore 40 that extends axially in the portion 2C of the casing and in which an axially-movable selector slide 42 is disposed. The bore 40 is provided with three communication ports, respectively 44, 46, and 48, which are connected to respective ones of the grooves 18, 19, and 20, via connection ducts, respectively 44', 46', and 48'. The slide 42 is mounted to move between two end positions inside the bore 40, in which positions it causes the ports 44 and 46 or the ports 46 and 48 to communicate via its groove 43.

When the selector 42 is in its position shown in FIG. 1, the grooves 19 and 20 communicate, so that the distribution orifices that are connected to them are at the same pressure, which is different from the pressure of the distribution orifices connected to the groove 18. When the selector 42 is moved in the direction indicated by arrow F, it is the distribution orifices connected to the grooves 18 and 19 that are put at the same pressure, which is different from the pressure at which the orifices connected to the groove 20 are put.

Figure 2:
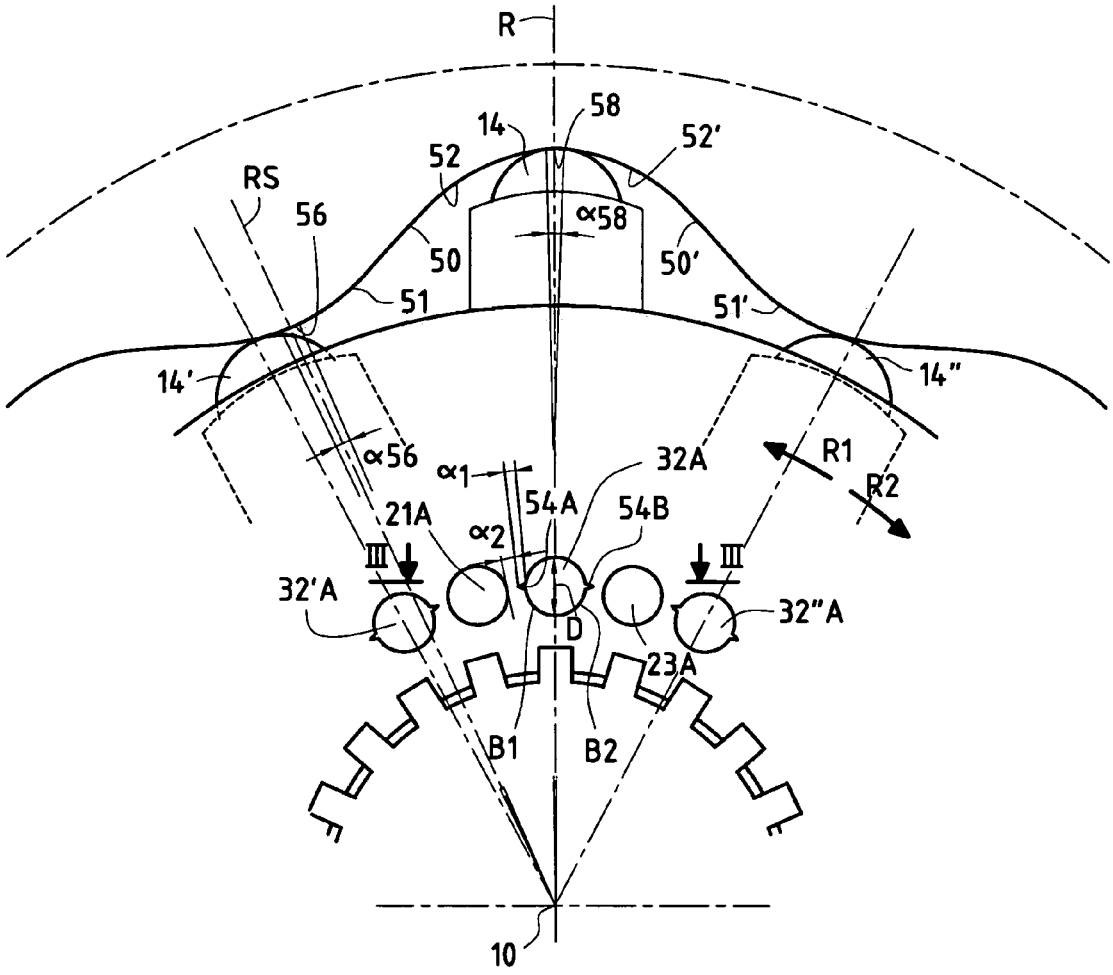
FIG. 2 is a fragmentary radial section view on line II—II of FIG. 1.

FIG. 2 shows a cam lobe with its two ramps, respectively 50 and 50'. Each of the two ramps has a convex portion, respectively 51 and 51', and a concave portion, respectively 52 and 52'. The convex portions are the portions that are closer to the axis of rotation 10 of the motor, while the concave portions are the portions that are further away from said axis. A piston 14 co-operates with the cam crest zone 58, via which the concave portions 52 and 52' of the ramps 50 and 50' meet. Said piston is in its top dead center position, i.e. the volume of the working chamber of the cylinder in which it moves is at its maximum. Other pistons 14' and 14" co-operate with other zones of the cam.

At this time, for the reasons described below, the communication orifice 32A via which the cylinder in which the piston moves 14 can be fed with fluid under pressure, and via which the fluid contained in the cylinder can be discharged, is isolated from any distribution orifice.

For reasons of clarity, FIG. 2 shows two distribution orifices, respectively 21A and 23A, e.g. connected to respective ones of the grooves 18 and 19, although said grooves are not normally visible in the section view. The positions of two other communication orifices, namely 32'A and 32"A, are also indicated.

The two communication orifices of FIG. 2 are identical, and each of them is provided with two notches, respectively 54A and 54B, suitable for establishing a small section of communication between the communication orifice equipped with said notches and the distribution orifices.

If it is considered that the cylinder block is moving relative to the distributor in the direction of rotation R1, the portion B1 of the edge of the communication orifice 32A in which the notch 54A is formed is a leading portion, i.e. it is via this portion that communication opens between the communication orifice 32A and the distribution orifice 21A. Thus, in a first stage, the communication is established via the notch 54A only, over an angle of relative rotation of the distributor and of the cylinder block equal to the angular amplitude $\alpha 1$ covered by the notch 54A. By means of the notch 54A, the communication between the communication orifice 32A and the distribution orifice 21A opens gradually, so that the pressure in the working chamber of the cylinder in which the piston 14 moves and the pressure in the distribution duct that opens out at the distribution orifice 21A can be balanced gradually. When the rotation continues, the communication opens widely as the orifices 32A and 21A mutually cover each other angularly.

When the cylinder block is rotating in the direction R1 relative to the distributor, the portion B2 of the edge of the communication orifice 32A that is opposite from the portion B1 constitutes a trailing portion, via which the communication between the communication orifice 32A and the distribution orifice 23A closes.

When the direction of rotation of the motor is reversed so that the cylinder block rotates relative to the distributor in the direction of rotation R2, it is the portion B2 of the edge of the communication orifice that constitutes a leading portion. In which case, the communication between the communication orifice 32A and the distribution orifice 23A opens via the notch 54B. The pressures in the working chamber of the cylinder in which the piston 14 moves and in the distribution duct that opens out at the distribution orifice 23A can then balance more gradually than in the prior art, in which the communication orifices are not provided with notches.

Thus, depending on the direction of rotation of the motor, one or other of the notches 54A and 54B is useful for avoiding or at least for limiting the phenomena of jolting when two enclosures in which different fluid pressures prevail are put into communication with each other too rapidly.

Figure 3:
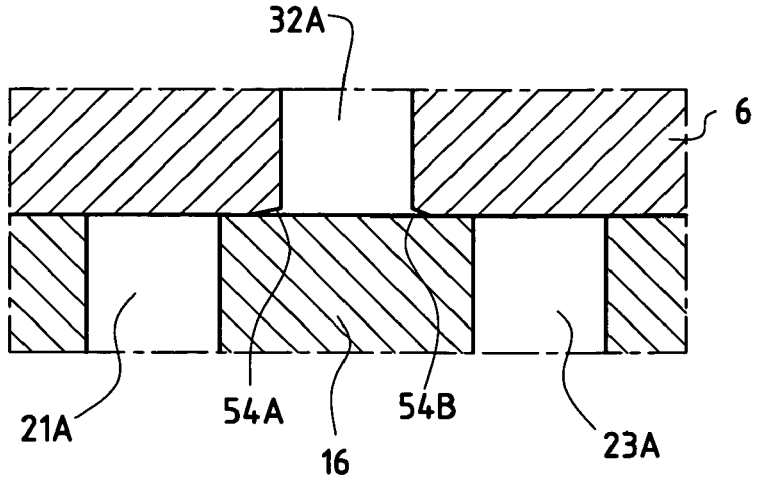
FIG. 3 is a view in section on the circular arc III—III of FIG. 2.

In the example of FIG. 2, the notches 54A and 54B are symmetrical about a diameter D of the communication orifice 32A that passes through the axis of rotation 10 of the motor. This can be seen in FIG. 3. As indicated above, it is however possible to make provision for the notches not to be symmetrical. In particular if the direction of rotation R1 in which the cylinder block is rotating relative to the distributor corresponds to the preferred operating direction of the motor and if, in its non-preferred direction, the speed is lower than the speed that can be reached by the preferred direction, then the notch 54A can be larger than the notch 54B.

The cam crest zone 56 and the cam trough zone 58 extend over respective angular sectors $\alpha_{56}$ and $\alpha_{58}$, as measured between two radii passing through the axis of the motor, that are substantially equal to each other and that are approximately equal to in the range 2° to 3°.

Advantageously, in order to make advantageous use of the cam trough zones and of the cam crest zones for balancing the pressures between the working chambers of the cylinders and the feed or discharge ducts of the motor, provision is made to choose the lapse of time for which communication between a communication orifice and a distribution orifice takes place via a notch to lie within the lapse of time for which the piston of the cylinder fed by said communication orifice co-operates with a cam trough zone or with a cam crest zone. Times for which the pistons are not contributing to the drive torque are thus used advantageously for balancing the pressures.

For example, with an angular sector of sealing $\alpha_2$ between the duct 21A and the duct 32A, provision is made to choose $\alpha_{58}=2\ (\alpha_1+\alpha_2)$, the cam trough zone being symmetrical about a radius R that determines an axis of symmetry for the cam lobe that has the ramps 50 and 50'; the angular sector of sealing $\alpha_2$ and the angular coverage of a notch $\alpha_1$ should be assessed, for a given direction of rotation, relative to a half cam trough zone. The same remark applies to the subject of the cam crest zone 56 which is symmetrical about the radius RS.

It is possible to make provision to chose the communication orifices to be circular except for the presence of the notches. In which case, the notches can be formed by moving a milling cutter in a diametrical plane of the communication orifice, which milling cutter cuts slightly into the edges of said orifice. In order to form symmetrical orifices, a diameter of the milling cutter can be coaxial with the diameter of the communication orifice, while, to interconnect asymmetrical notches, the diameter of the milling cuter can be offset slightly relative to the diameter of the communication orifice.

Figure 4:
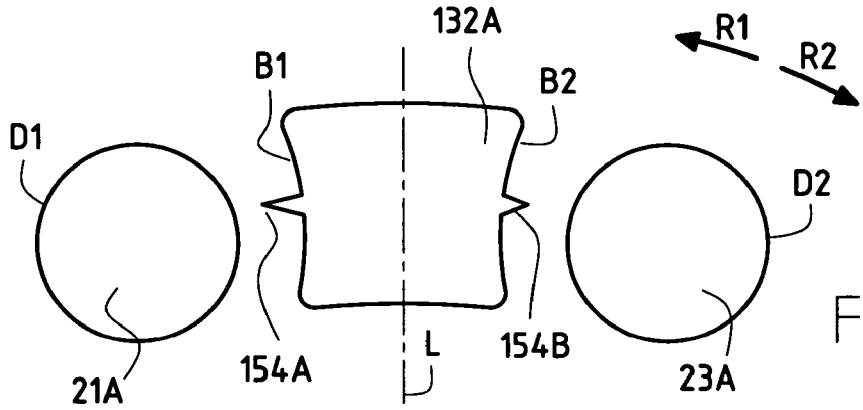
FIGS. 4 and 5 show, in fragmentary radial section, two variant embodiments.

In the example shown in FIG. 4, and like the orifice 32A, the communication orifice 132A has a leading portion B1 and a trailing portion B2 when the cylinder block turns relative to the distributor in the direction of rotation R1. However, it can be noted that, for the orifice 132A, the leading portion B1 and the trailing portion B2 are substantially convex, as seen from inside the orifice. With the exception of the notches 154A and 154B, the leading portion and the trailing portion form substantially circular arcs suitable for covering the edges of the distribution orifices 21A and 23A while the cylinder block is rotating relative to the distributor. The shape of the communication orifice is substantially complementary to the shape of the distribution orifices 21A and 23A.

If it is considered that the cylinder block is turning in the direction of rotation R1 relative to the distributor, then the communication between the communication orifice 132A and the distribution orifice 21A starts via the notch 154A which, as indicated above, establishes a small section of communication making it possible to balance gradually the pressures in the enclosures respectively connected to the distribution orifice and to the communication orifice. However, as soon as the angle of relative rotation between the cylinder block and the distributor is sufficient, the leading portion B1 of the communication orifice passes beyond the edge D1 of the distribution orifice, in the direction R1, and, as from this situation, the section of overlap between the communication orifice and the distribution orifice increases very quickly as a function of the angle of relative rotation between the cylinder block and the distributor. In other words, as soon as the pressure in the enclosures connected respectively to the communication orifice and to the distribution orifice have been more or less balanced via the small section of communication allowed by the notch 154A, the communication between the orifices 132A and 21A can increase very quickly, with very low head loss. By means of the notch, the jolting phenomena are avoided or at least limited and, by means of the particular shape of the leading portion B1, the efficiency of the motor is increased.

If the motor has a single direction of rotation, in which the cylinder block turns in the direction R1 relative to the distributor, then it is not necessary for the trailing portion B2 to have a shape substantially complementary to the shape of the portion D2 of the edge of the orifice 23A via which the communication between the orifices 132A and 23A closes. Conversely, if the motor has two operating directions, neither of which is preferred, then the trailing portion B2, which becomes a leading portion in the direction of rotation R2, is advantageously shaped like the portion B1, symmetrically about a line L of symmetry of the orifice 132A that passes through the axis of rotation of the motor.

Naturally, when the motor has two directions of rotation, only one of which is preferred, it is possible to choose to make provision for only those portions of the edges of the communication orifices which constitute leading portions in a preferred direction to be formed substantially complementary to those portions of the edges of the distribution orifices via which the communication between the communication orifices and the distribution orifices open.

When the distribution orifices are circular, the communication orifices can, with the exception of the notches, have shapes of the type described in FR-A-2 587 761. Conversely, the distribution orifices can have a shape such that, without their notches, the communication orifices are circular.

Figure 5:
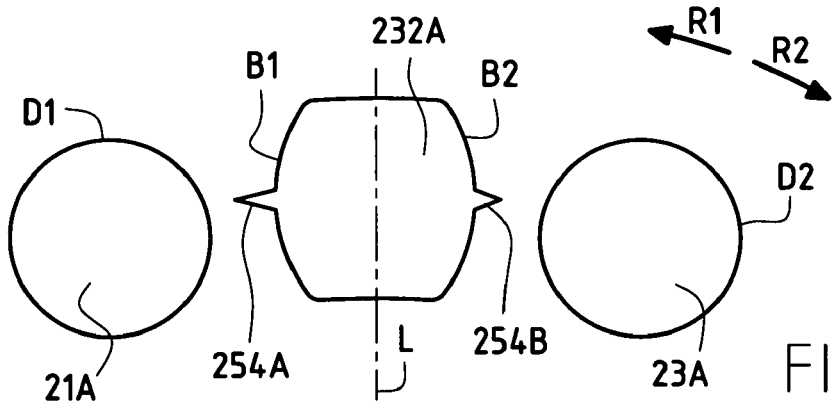

FIG. 5 shows another variant, in which the communication orifice 232A has a shape that is substantially elongate along a radius of the motor that passes through the axis of rotation thereof. In other words, except for the notches 254A and 254B, the dimension of the orifice 232A, as measured along a radius of the motor, is larger than the dimension of said orifice as measured transversely to said radius. Without having the relatively complex shape of the orifice 132A, the communication orifice 232A offers, like that orifice, the advantage of enabling the communication between the communication orifice 232A and the distribution orifice 21A or the distribution orifice 23A to open very quickly as from the time when the pressure in the enclosures connected respectively to the communication orifice and to the distribution orifices has been substantially balanced due to the orifices in question being put into limited communication via the notch 254A or via the notch 254B.

FIG. 5 shows that the notch 254A is larger than the notch 254B, the direction of rotation R1 in which the cylinder block rotates relative to the distributor being a preferred direction relative to the opposite direction R2.

In the figures described above, the notches in the communication orifices are substantially disposed on a circular arc going through the axis of rotation of the motor.

In a variant (not shown), it is also possible to choose to dispose all of the notches in the leading portions of the orifices on a first circle centered on the axis of rotation of the motor, and all of the notches in the trailing portions of said orifices on a second circle, of radius different from the first circle.

As indicated above, the motor shown in FIG. 1 has two active operating cubic capacities, a cubic capacity selector making it possible to put certain distribution ducts into communication with one another. Some of the pairs of consecutive communication orifices have orifices connected to the same pressure, so as to make the motor operate in its small cubic capacity.

Another manner exists for making the motor operate in two different cubic capacities, consisting in making certain pistons inactive. That type of small cubic capacity control is described, for example, by Patent Application No. FR-A-2 796 992.

In which case, the deactivated pistons are, in general, declutched, by being brought towards the axis of rotation of the motor. In any event, in this situation, only the pistons that remain active contribute to generating drive torque. In the small cubic capacity, for the same flow-rate of fluid delivered by the pump feeding the motor, said motor turns at a speed higher than the speed at which it would be turned for the same flow-rate of fluid in the large cubic capacity.

The above-mentioned pressure reduction and jolting phenomena are even more perceptible when the motor operates at high speed. Thus, in the invention, it is possible to make provision for only each of those communication orifices of the piston cylinders which are active in the small operating cubic capacity to be provided with at least one notch in its edge. In which case, each of the communication orifices of those cylinders has a notch, while the communication orifices of the other cylinders are not provided with notches. Depending on whether or not the motor is reversible, and for the reasons indicated above, it is possible to make provision for each of the communication orifices having at least one notch to have a single notch or else to have two notches, serving for opening the communication between said orifices and the distribution orifices in respective ones of the two operating directions of the motor.

In which case, since the maximum speed of rotation is smaller in the large cubic capacity than in the small cubic capacity, it can be deemed unnecessary to provide notches in the orifices of the cylinders of the pistons that are inactive in the small cubic capacity.

In a variant, it is possible to form the notches in the edges of all of the communication orifices. However, insofar as the maximum speed in the large cubic capacity is lower than the maximum speed in the small cubic capacity, it is possible to make provision for the edges of the communication orifices of the cylinders whose pistons are active in the small cubic capacity to have notches that are larger than the notches in the edges of the communication orifices of the cylinders of the pistons that are inactive in the small cubic capacity.

The invention claimed is:

1. A hydraulic motor having radial pistons, and comprising a cam and a cylinder block that are suitable for turning relative to each other about an axis of rotation, the cylinder block having radial cylinders connected via cylinder ducts to communication orifices situated in a communication face of the cylinder block that is perpendicular to the axis of rotation, pistons mounted to slide in the cylinders being suitable for co-operating with the cam, which cam is provided with a plurality of lobes, each of which has two ramps, the motor further comprising a fluid distributor having a distribution face that is perpendicular to the axis of rotation and that is suitable for being in abutment against the communication face of the cylinder block, said distribution face being provided with distribution orifices comprising orifices suitable for being connected to a fluid feed and orifices suitable for being connected to a fluid discharge, the fluid distributor being constrained to rotate with the cam, so that there is one ramp of the cam that corresponds to each distribution orifice, said distribution orifices being suitable for communicating one after another with the communication orifices while the cylinder block and the distributor are turning relative to each other, an edge of each of at least certain communication orifices being provided with at least one notch suitable for establishing a small section of communication with a distribution orifice.

2. A motor according to claim 1, in which the edge of each communication orifice has a leading portion via which communication between the communication orifice and the distribution orifices opens while the cylinder block and the distributor are turning relative to each other in a given direction of relative rotation, and a trailing portion via which communication between the communication orifice and the distribution orifices closes while the cylinder block and the distributor are turning relative to each other in said direction of relative rotation, each leading portion and each trailing portion of the edges of at least certain communication orifices having a notch suitable for establishing a small section of communication with a distribution orifice.

3. A motor according to claim 2, wherein the notches in the leading portion and in the trailing portion of the edge of each of said communication orifices are symmetrical.

4. A hydraulic motor according to claim 2, having two directions of rotation, one of which directions being a preferred direction, wherein those portions of the edges of said communication orifices which, in the preferred operating direction, constitute respectively the leading portions and the trailing portions are provided respectively with large notches and with small notches.

5. A hydraulic motor according to claim 1, wherein the edge of each communication orifice has a leading portion via which communication between the communication orifice opens while the cylinder block and the distributor are rotating relative to each other in a given direction of relative rotation, and a trailing portion via which communication between the communication orifice and the distribution orifices closes while the cylinder block and the distributor are rotating relative to each other in the same direction of relative rotation, and wherein, for at least certain communication orifices, at least the leading portion has a shape that is substantially complementary to a shape of the edges of the distribution orifices via which the communication between the communication orifices and the distribution orifices open.

6. A motor according to claim 5, wherein the distribution orifices are substantially circular, and wherein, for each of at least some of the communication orifices, the leading portion of the orifice has a convex shape as seen from the inside of the orifice.

7. A motor according to claim 6, wherein for at least some of the communication orifices, the leading portion and the trailing portion are substantially convex, as seen from inside the orifice.

8. A motor according to claim 1, wherein each ramp of the cam has a convex portion and a concave portion, two adjacent ramps being connected together either via a cam crest zone extending between their respective convex regions, or via a cam trough zone extending between their respective concave regions, wherein said cam crest zone and said cam trough zone are substantially circular arcs centered on the axis of rotation, so that when the pistons are co-operating with said zones, radial strokes of said pistons are substantially zero, and wherein the distribution orifices and the communication orifices have dimensions such that, while the cylinder block and the distributor are rotating relative to each other, each distribution orifice remains momentarily isolated from any communication orifice.

9. A motor according to claim 1, having two active operating cubic capacities, namely a large cubic capacity in which all of the pistons are active, and a small cubic capacity in which only certain pistons are active, wherein only each of the communication orifices of the cylinders of the pistons that are active in the small cubic capacity is provided with a notch in its edge.

10. A motor according to claim 1, having two active operating cubic capacities, namely a large cubic capacity in which all of the pistons are active, and a small cubic capacity in which only certain pistons are active, wherein only the edges of all of the communication orifices have at least one notch each, and wherein the edges of the communication orifices of the cylinders of the pistons that are active in the small cubic capacity have notches that are larger than the notches in the edges of the communication orifices of the cylinders of the pistons that are inactive in the small cubic capacity.

* * * * *